US011427447B2

(12) United States Patent
Matamoros et al.

(10) Patent No.: US 11,427,447 B2
(45) Date of Patent: Aug. 30, 2022

(54) ANGULATED PARKING

(71) Applicant: Ford Global Technologies, LLC, Dearborn, MI (US)

(72) Inventors: Alejandra Matamoros, Mexico City (MX); Aida Fuentes Manzanero, Mexico City (MX); Cesar Allan Martinez, Nezahualcoyotl (MX); Adrian Romero Regalado, Cuautitlan Izcalli (MX)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 854 days.

(21) Appl. No.: 16/322,152

(22) PCT Filed: Aug. 1, 2016

(86) PCT No.: PCT/US2016/044982
§ 371 (c)(1),
(2) Date: Jan. 31, 2019

(87) PCT Pub. No.: WO2018/026347
PCT Pub. Date: Feb. 8, 2018

(65) Prior Publication Data

US 2019/0177138 A1 Jun. 13, 2019

(51) Int. Cl.
*B66F 1/06* (2006.01)
*E04H 6/18* (2006.01)
(Continued)

(52) U.S. Cl.
CPC ..... *B66F 1/06* (2013.01); *B66F 5/00* (2013.01); *B66F 5/025* (2013.01); *B66F 7/00* (2013.01);
(Continued)

(58) Field of Classification Search
CPC .... B60S 11/00; B60S 9/10; B66F 3/16; B66F 5/00; B66F 5/02; B66F 5/025; B66F 7/10;
(Continued)

(56) References Cited

U.S. PATENT DOCUMENTS 3,035,812 A * 5/1962 Wineteer ..... B66F 5/00 254/2 R
3,675,795 A 7/1972 Dluhy
(Continued)

FOREIGN PATENT DOCUMENTS

CN 102758549 A 10/2012
CN 203247893 U 10/2013
(Continued)

OTHER PUBLICATIONS

China Notification of First Office Action dated May 27, 2020; re Appl. No. 2016800881529.
(Continued)

*Primary Examiner* — Tyrone V Hall, Jr.
(74) *Attorney, Agent, or Firm* — Brandon Hicks; Bejin Bieneman PLC

(57) ABSTRACT

A parking robot includes a lifting rail, a wheel clamp, and a lift motor. The wheel clamp is disposed on the lifting rail and is moveable from a first position to a second position along the lifting rail. The lift motor is operatively connected to the lifting rail and moves the wheel clamp from the first position to the second position.

14 Claims, 11 Drawing Sheets

(51) Int. Cl.

| | |
|---|---|
| ***B66F 7/00*** | (2006.01) |
| ***B66F 5/00*** | (2006.01) |
| ***B66F 7/14*** | (2006.01) |
| ***B66F 7/28*** | (2006.01) |
| ***B66F 7/22*** | (2006.01) |
| ***B66F 5/02*** | (2006.01) |
| ***E04H 6/34*** | (2006.01) |
| ***E04H 6/36*** | (2006.01) |
| ***E04H 6/42*** | (2006.01) |
| ***E04H 6/38*** | (2006.01) |

(52) U.S. Cl.
CPC ..... *B66F 7/14* (2013.01); *B66F 7/22* (2013.01); *B66F 7/28* (2013.01); *E04H 6/18* (2013.01); *E04H 6/34* (2013.01); *E04H 6/36* (2013.01); *E04H 6/38* (2013.01); *E04H 6/42* (2013.01); *B66F 2700/025* (2013.01); *B66F 2700/12* (2013.01)

(58) Field of Classification Search
CPC .... B66F 7/12; B66F 7/14; B66F 7/246; B66F 7/28; B66F 9/184; B66F 2700/123; B66F 2700/052; E04H 6/18; E04H 6/24
See application file for complete search history.

(56) References Cited

U.S. PATENT DOCUMENTS

| | | | | |
|---|---|---|---|---|
| 4,609,179 | A * | 9/1986 | Chern ..... | B66F 3/10 254/102 |
| 5,518,220 | A | 5/1996 | Bertrand et al. | |
| 2010/0283016 | A1 | 11/2010 | Drake | |
| 2013/0280018 | A1 | 10/2013 | Meirer et al. | |

FOREIGN PATENT DOCUMENTS

| | | | |
|---|---|---|---|
| CN | 104612437 | A * | 5/2015 |
| CN | 104831971 | A | 8/2015 |
| CN | 105201250 | A | 12/2015 |
| CN | 204876730 | U | 12/2015 |
| CN | 205394584 | U | 7/2016 |
| EP | 0449521 | A1 | 10/1991 |

OTHER PUBLICATIONS

International Search Report and Written Opinion dated Oct. 7, 2016 re PCT/US2016/044982.

* cited by examiner

ANGULATED PARKING

BACKGROUND

Space is often a concern in urban areas. High population density often means traffic congestion and limited or expensive parking options. Further, parking revenue is limited by the capacity of the parking lot. Larger lots have to opportunity to receive more revenue simply because larger lots have a larger capacity than smaller lots.

DETAILED DESCRIPTION

One way to increase parking capacity without changing the footprint of a parking lot is by vertically angling the vehicles. Vertically angling the vehicles includes lifting the front or rear end of the vehicle off the ground. Doing so reduces the amount of space each vehicle takes up.

One way to vertically angle vehicles is with a parking robot having lifting rails, wheel clamps, and a lift motor. Each wheel clamp is disposed on one of the lifting rails and is moveable from a first position to a second position along the lifting rail. The lift motor is operatively connected to each of the lifting rails. The lift motor moves the wheel clamp from the first position to the second position. Thus, when the wheel clamps receive the wheels of a vehicle while the wheel clamps are in the first position (e.g., near the ground), the parking robot can move the wheel clamps up to the second position (e.g., away from the ground) to lift the front or rear of the vehicle.

The elements shown may take many different forms and include multiple and/or alternate components and facilities. The example components illustrated are not intended to be limiting. Indeed, additional or alternative components and/or implementations may be used. Further, the elements shown are not necessarily drawn to scale unless explicitly stated as such.

Figure 1:
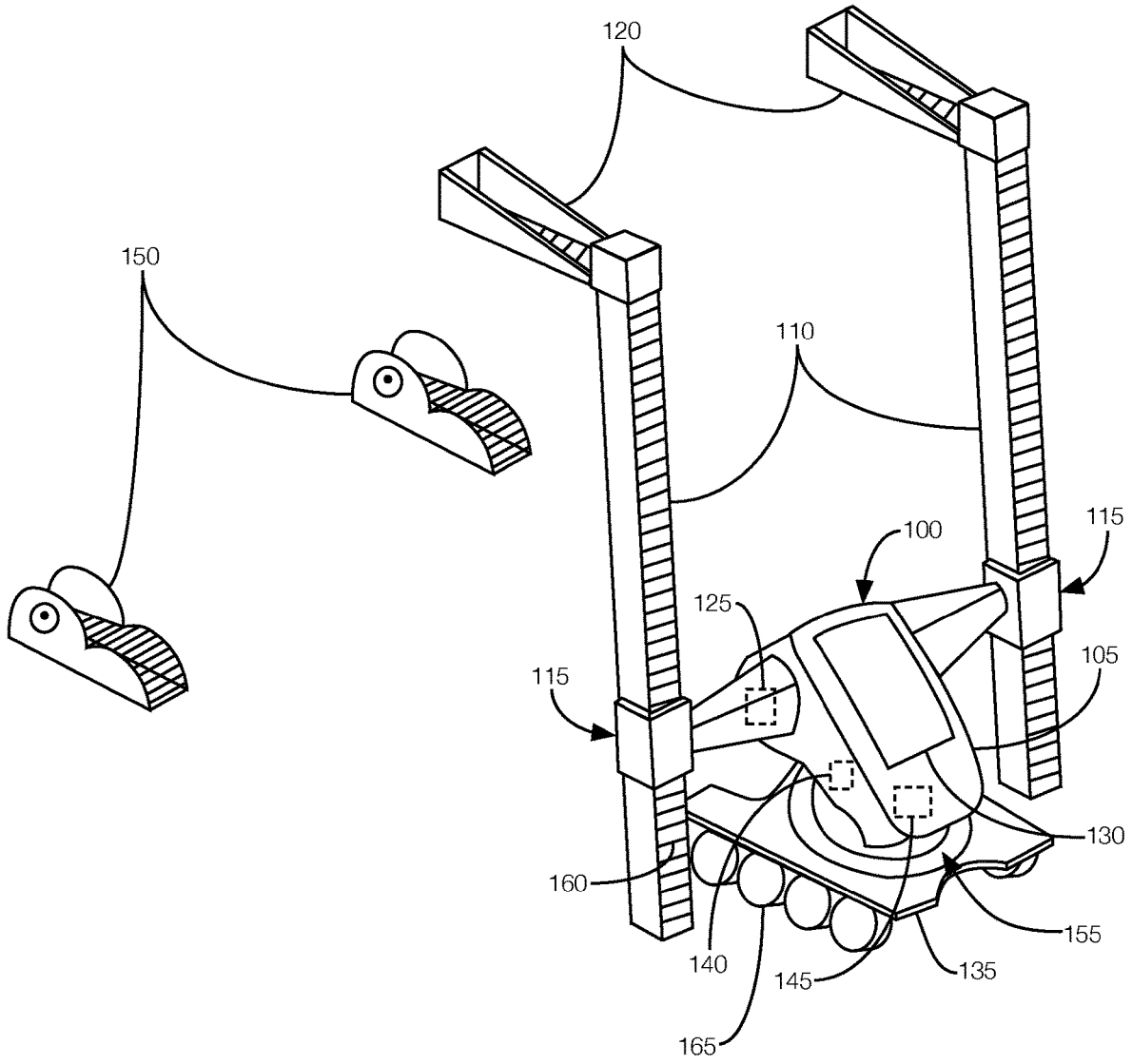
FIG. 1 illustrates an example parking robot for angulated parking.

As illustrated in FIG. 1, a parking robot 100 for angulated vehicle parking includes a housing 105, lifting rails 110, a grip assembly 115, wheel clamps 120, a lift motor 125, a user interface 130, a platform 135, autonomous driving sensors 140, and a processor 145. Further, FIG. 1 illustrates rear wheel chocks 150 that may be used to help hold the vehicle in place.

The housing 105 may be formed from a rigid material such as plastic or metal and may structurally support other components of the parking robot 100. For instance, the housing 105 may structurally support the grip assembly 115, which in turn may support the lifting rails 110. The lift motor 125 may be located inside the housing 105, and the user interface 130 may be located on an exterior surface of the housing 105. Other components that may be located inside the housing 105 include a pneumatic pump to drive the grip assembly 115, one or more batteries to power various electronic components of the parking robot 100, a navigation system for determining the location of the parking robot 100 and planning routes to particular destinations, the processor 145, one or more controllers for controlling certain operation of the parking robot 100, etc. Moreover, the housing 105 may include a rotation mechanism 155 (e.g., a ball and socket joint and an electric drive motor) for rotating relative to the platform 135, as discussed in greater detail below.

The lifting rails 110 may be formed of a rigid, high strength material that, when used together, are strong enough to support the weight of a vehicle. While only two lifting rails 110 are shown in FIG. 1, the parking robot 100 may use any number of lifting rails 110. In some instances, the rails work in conjunction with a ratchet assembly incorporated into the grip assembly 115 or elsewhere. That is, the rails may include a series of bars 160 with spaces in between for receiving a pawl, cog, or tooth to keep the lifting rail 110 elevated despite at least partially supporting the weight of a vehicle. Operation of the lifting rails 110 is discussed in greater detail below with regard to FIGS. 6A-6B.

Each grip assembly 115 extends from the housing 105 the one of the lifting rails 110. In one possible implementation, each grip assembly 115 may be fixed relative to the housing 105 and may releasably attach to the one of the lifting rails 110. As mentioned above, one or more grip assemblies 115 may include ratchet components (pawl, cog, or tooth, for example) that can extend between the bars 160 of the lifting rail 110 to hold the lifting rail 110 despite the lifting rail 110 at least partially supporting the weight of the vehicle. Thus, the grip assemblies 115 may bear some of the weight of the vehicle. Moreover, the grip assemblies 115 may be electrically or pneumatically operated to grip and release the lifting rails 110. The grip assemblies 115 are discussed in greater detail below with reference to FIGS. 5A-5D.

The wheel clamps 120 are disposed on the lifting rails 110 and, in some instances, may move relative to the lifting rails 110. For instance, the wheel clamps 120 may be movable from a first position (at or near the ground) to a second position (away from the ground). As shown in FIG. 1, the wheel clamps 120 are in the second position since the wheel clamps 120 are located near the top of the lifting rails 110. The wheel clamps 120 are discussed in greater detail below with respect to FIGS. 3A-3B and 4A-4B.

The lift motor 125 may be implemented as an electric DC motor that converts electrical energy into motion, such as rotational motion. For instance, the lift motor 125 may include a shaft operatively connected to the lifting rails 110 (see FIGS. 6A-6B). Rotation of the shaft may cause the lifting rails 110 to move up or down. That is, rotation of the shaft in one direction (e.g., clockwise or counter clockwise) may cause the lifting rails 110 to move up and rotation of the shaft in the opposite direction may cause the lifting rails 110 to move down. In one possible implementation, the rotation of the shaft may cause the wheel clamps 120 to move along the lifting rails 110. In this possible approach, the wheel clamps 120 may move relative to the lifting rails 110 while the lifting rails 110 are stationary. Thus, the rotation of the shaft in one direction may move the wheel clamps 120 up to a first position and rotation of the shaft in the opposite direction may move the wheel clamps 120 down to the second position. The first position may be at or near the ground so the wheel clamps 120 can receive the wheels of the vehicle and the second position may be spaced from the ground to place the vehicle in an angulated parking position.

In some possible approaches, the lift motor 125 may be located outside the parking robot 100, such as in the floor. For example, the parking robot 100, as discussed in greater detail below, may set the lifting rails 110 into designated areas in the floor where the lift motor 125 may lift the wheel clamps 120 from the first position to the second position. Thus, the parking robot 100 need not wait for the vehicle to be fully angulated before leaving to retrieve the next vehicle queued for angulated parking.

The user interface 130 is implemented via circuits, chips, or other electronic components that can present information to a user and receive user inputs. For instance, the user interface 130 may include an electronic display screen. Further, the user interface 130 may include buttons for receiving user inputs. The buttons may be located near the display screen. In one possible approach, the buttons may be contextual softkeys so the user input may be based on the information presented on the display screen at the time the button is pressed. Further, in some implementations, the user interface 130 may include a touch sensitive display screen that both presents information to the user and receives user input via, e.g., virtual buttons. In some possible approaches, the user interface 130 may be equipped for wireless communication. For instance, the user interface 130 may include various chips or circuits for wirelessly communicating with a user's mobile device according to any number of wireless communication protocols. Examples of such protocols may include Bluetooth®, Bluetooth® Low Energy, WiFi, Near Field Communication (NFC), etc. The user interface 130 may pair or otherwise communicate with the user's mobile device and receive instructions sent from the user's mobile device. Such instructions may include instructions for the parking robot 100 to retrieve the vehicle from a parking area, tow the vehicle to the parking location, and park the user's vehicle at the parking location in an angulated position. Other instructions may include instructions for the parking robot 100 to retrieve the user's vehicle from the parking location and tow the vehicle to the parking area to deliver the vehicle back to its owner.

The platform 135 is formed of a rigid material, such as metal or plastic, that can support the housing 105 and possibly other components of the parking robot 100. The platform 135 may be rotatably connected to the housing 105 so that, e.g., the housing 105 can rotate relative to the platform 135. For instance, the platform 135 may define an opening for receiving the rotation mechanism 155 of the housing 105. The electric drive motor of the rotation mechanism 155 may convert electrical energy into motion to rotate the housing 105 relative to the platform 135. Further, wheels 165 may be located on the bottom of the platform 135, and the wheels 165 may be driven by the same or another drive motor as that incorporated into the rotation mechanism 155. In some instances, a pneumatic suspension may be mounted to the platform 135 to help the parking robot 100 navigate over certain types of terrain or while towing or parking a vehicle.

The autonomous driving sensors 140 are implemented via circuits, chips, or other electronic components that can help autonomously navigate the parking robot 100. Examples of autonomous driving sensors 140 include one or more lidar sensors, radar sensors, vision sensors (e.g., cameras), ultrasonic sensors, or the like. The sensors may sense the environment around the parking robot 100 and output signals representing the sensed environment to the processor 145.

The processor 145 is implemented via circuits, chips, or other electronic components programmed to carry out certain operations of the parking robot 100. The processor 145 may be programmed to receive various user inputs, such as user inputs provided via the user interface 130, commanding the parking robot 100 to, e.g., park a particular vehicle, retrieve a particular vehicle, etc. The processor 145 may be further programmed to receive signals output by the navigation system representing the present location of the parking robot 100, a destination of the parking robot 100, a route from the present location to the destination, etc. The processor 145 may be further programmed to receive signals output by the autonomous driving sensors 140. The processor 145 may be programmed to output command signals to various components of the parking robot 100 in accordance with the user inputs, the signals from the navigation system, the signals from the autonomous driving sensors 140, etc. For instance, the processor 145 may output command signals commanding the drive motor to turn the housing 105 relative to the platform 135, commanding the same or a different drive motor to turn the wheels 165 to move the parking robot 100 in a particular direction, command the lift motor 125 to move the wheel clamps 120 from the first position to the second position, command the lift motor 125 to move the wheel clamps 120 from the second position from the first position, command the grip assembly 115 to grip the lifting rails 110, command the grip assembly 115 to release the lifting rails 110, etc. More operations of the processor 145 are discussed below with reference to FIGS. 9 and 10.

The wheel chocks 150 may be formed of a relatively rigid material such as metal or plastic. As discussed in greater detail below with respect to FIGS. 8A-8C, the wheel chocks 150 may receive the front or rear wheels of the vehicle and hold the front or rear wheels of the vehicle in place while the vehicle is parked. The wheel chocks 150 may allow the vehicle wheels to rotate while disposed in the chocks. That way, the wheel chocks 150 will not prevent the angulation of the vehicle when, e.g., the wheel clamps 120 are moved from the first position to the second position along the lifting rails 110.

Figure 2:
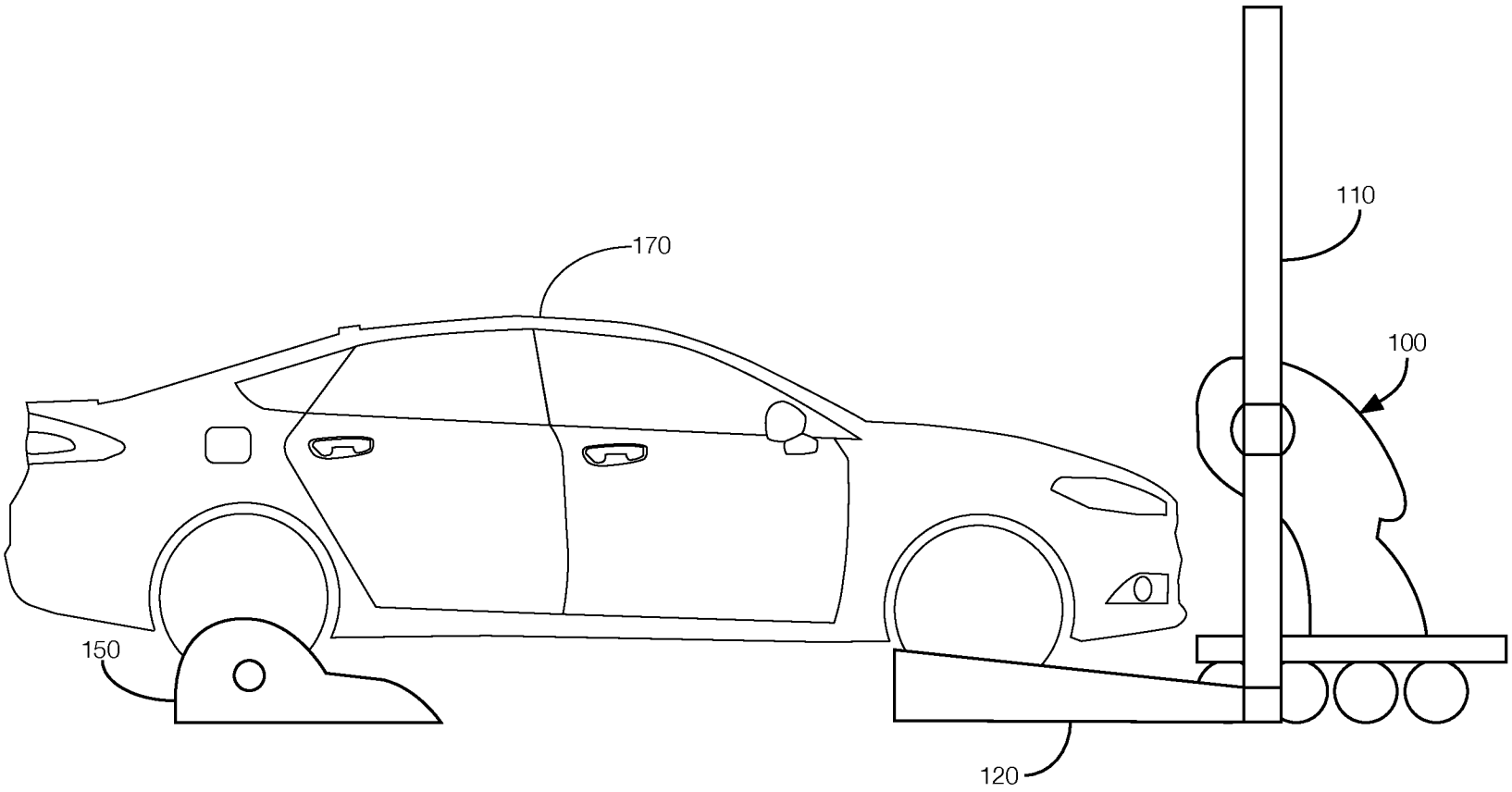
FIG. 2 illustrates the example parking robot with a vehicle while the lifting rails are in the first position.

FIG. 2 illustrates the parking robot 100 with a vehicle 170. The rear vehicle wheels are located in the wheel chocks 150 and the front vehicle wheels are located in the wheel clamps 120. The parking robot 100 has the wheel clamps 120 in the first position so the vehicle 170 can be manually driven onto the wheel chocks 150 and the wheel clamps 120.

Figure 3A:
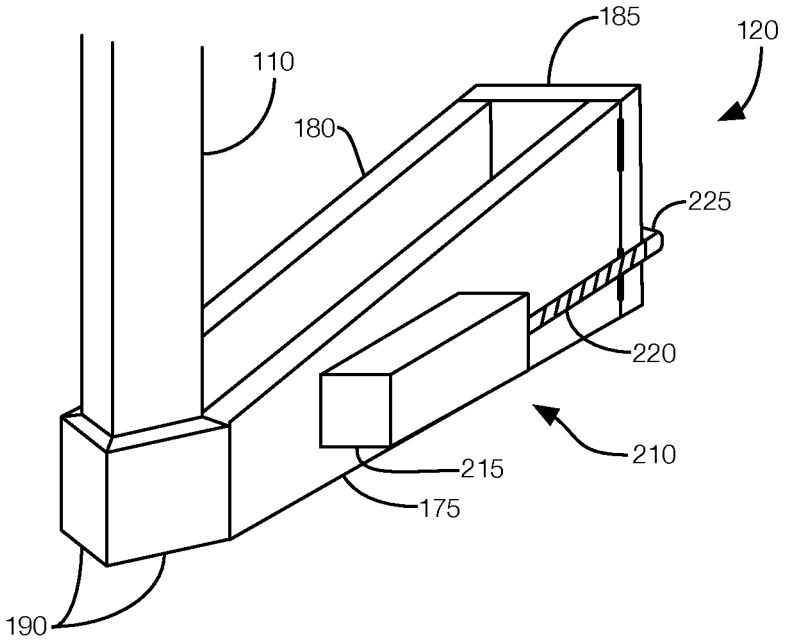
FIGS. 3A and 3B illustrate example components of a wheel clamp of the parking robot.
Figure 3B:
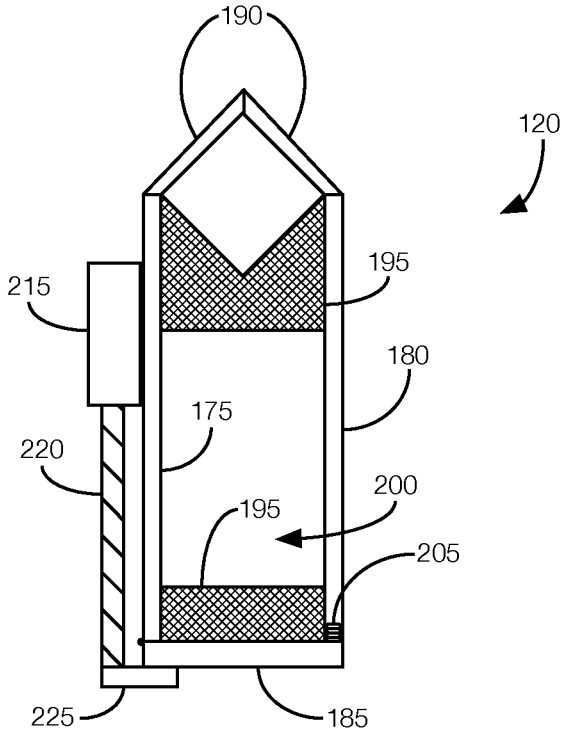

Referring now to FIGS. 3A-3B, in one possible implementation, the wheel clamps 120 include a first side wall 175, a second side wall 180, and a clamping wall 185. The first side wall 175 and the second side wall 180 are spaced from one another, and may be parallel to one another. The first side wall 175 and the second side wall 180 may attach to the lifting rail 110 in a way that allows the wheel clamp 120 to move from the first position to the second position and back to the first position. As shown in FIGS. 3A-3B, the wheel clamps 120 include additional walls 190, attached to either the first side wall 175 or the second side wall 180 and to one another, that attach to the lifting rails 110. Examples of how the wheel clamps 120 move relative to the lifting rails 110 is discussed in greater detail below with respect to FIGS. 6A and 6B. Moreover, the wheel clamps 120 include a floor 195 with an opening 200 for receiving and at least partially supporting a vehicle wheel.

The clamping wall 185 is hingedly attached to the first side wall 175 and moveable from an open position to a closed position. The clamping wall 185 is disposed on both the first side wall 175 and the second side wall 180 when in the closed position. In one possible approach, the clamping wall 185 may be biased toward the open position. For instance, a spring 205 may be attached to or located inside the second side wall 180 to push the clamping wall 185 away from an edge of the second side wall 180.

The wheel clamps 120, as shown in FIGS. 3A and 3B, include a wall actuator 210 for moving the clamping wall 185 from the open position to the closed position. The wall actuator 210 includes a wall motor 215, an endless screw 220, and a finger 225. The wall motor 215 may include an electric DC motor that rotates in accordance with electric power. The wall motor 215 may be powered via a dedicated battery (e.g., a battery on or near the wall motor 215) or a battery located in the housing 105 of the parking robot 100. The wall motor 215 may have a shaft that rotates, either clockwise or counter clockwise, in accordance with the electric power received, and the shaft may be attached to the endless screw 220. The endless screw 220 may be at least partially threaded and may rotate in accordance with the shaft of the motor. The finger 225 may be disposed at or near the end of the endless screw 220 and may rotate with the endless screw 220. The finger 225 may also engage the clamping wall 185 when the endless screw 220 is rotated. For instance, rotating the endless screw 220 may cause the finger 225 to engage the clamping wall 185. Continuing to rotate the endless screw 220 may cause the finger 225 to push the clamping wall 185 to the closed position. Thus, the rotation of the endless screw 220 may overcome the bias of the spring 205 keeping the clamping wall 185 in the open position. Rotating the endless screw 220 in the opposite direction may cause the finger 225 to disengage from the clamping wall 185, which may result in the spring 205 pushing the clamping wall 185 back to the open position.

Figure 4A:
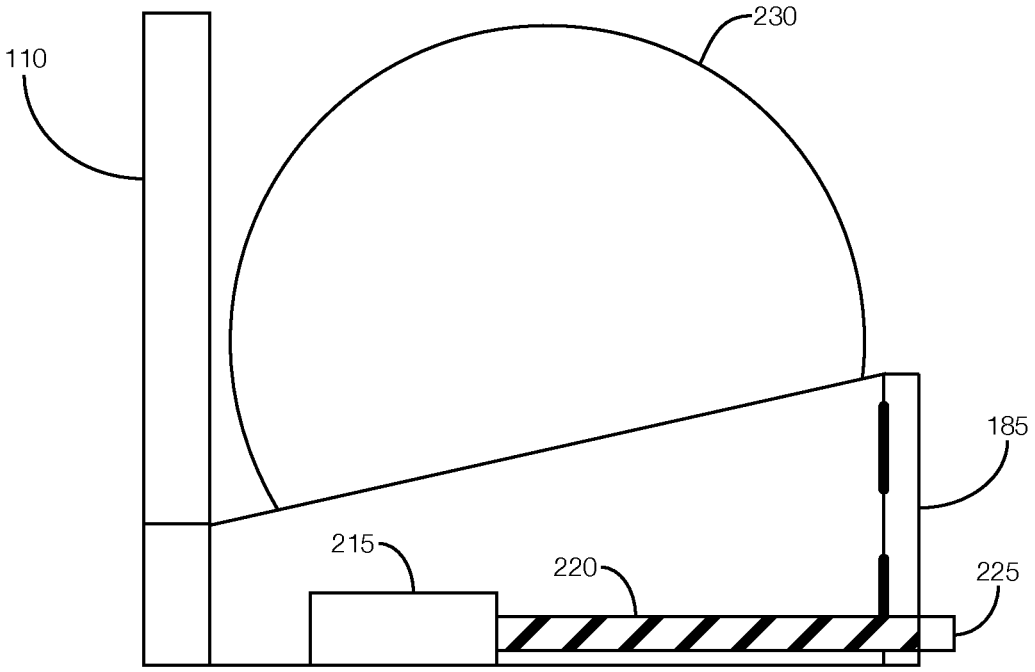
FIGS. 4A and 4B illustrate the wheel clamp engaging a vehicle wheel when the lifting rails are in the first position and a second position, respectively.
Figure 4B:
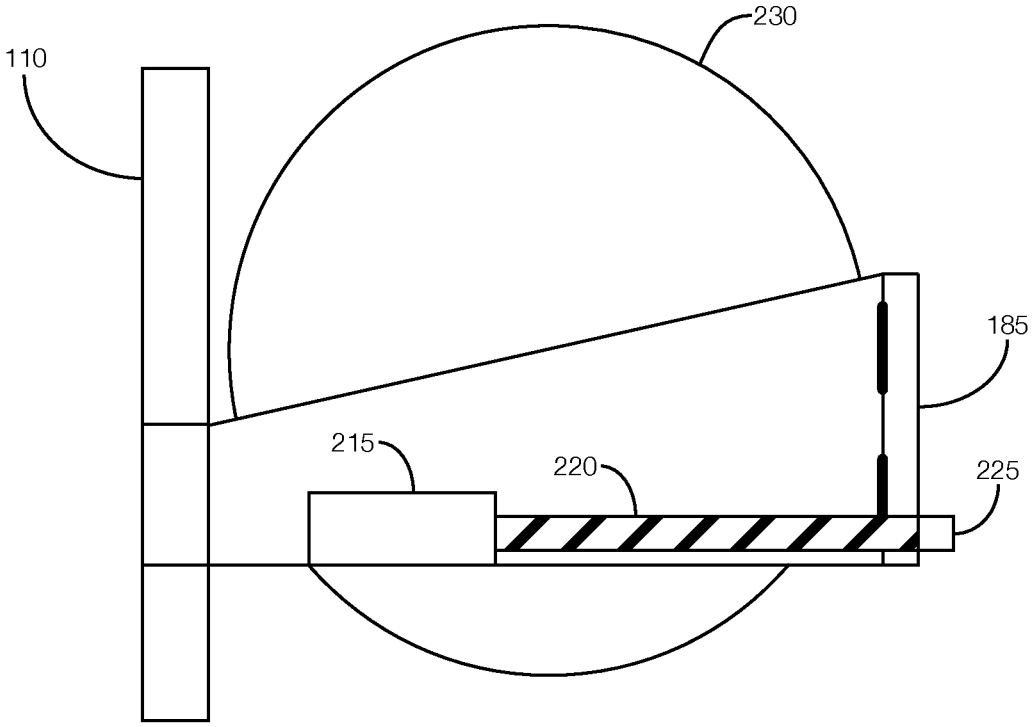

FIGS. 4A and 4B illustrate the wheel clamps 120 in the first position and the second position, respectively. In FIG. 4A, the vehicle is driven toward the wheel clamp 120, and the wheel clamp 120 receives the vehicle wheel 230. When the vehicle wheel 230 is in the wheel clamp 120, e.g., between the first side wall 175 and the second side wall 180, the wall actuator 210 may close the clamping wall 185. For instance, the wall motor 215 may rotate the endless screw 220, which in turn causes the finger 225 to engage the clamping wall 185 and overcome the bias of the spring 205. The wall motor 215 may keep the finger 225 in the rotated position (i.e., engaged with the clamping wall 185) to reduce the likelihood that the vehicle wheel 230 will slip out of the wheel clamp 120 while the wheel clamp 120 is moved from the first position to the second position. In FIG. 4B, the wheel clamp 120 is elevated to the second position. The vehicle wheel 230 may be at least partially supported by the floor 195 (see FIG. 3B) of the wheel clamp 120, and at least a portion of the wheel may extend below the floor 195 via the opening 200 (see FIG. 3B).

Figure 5A:
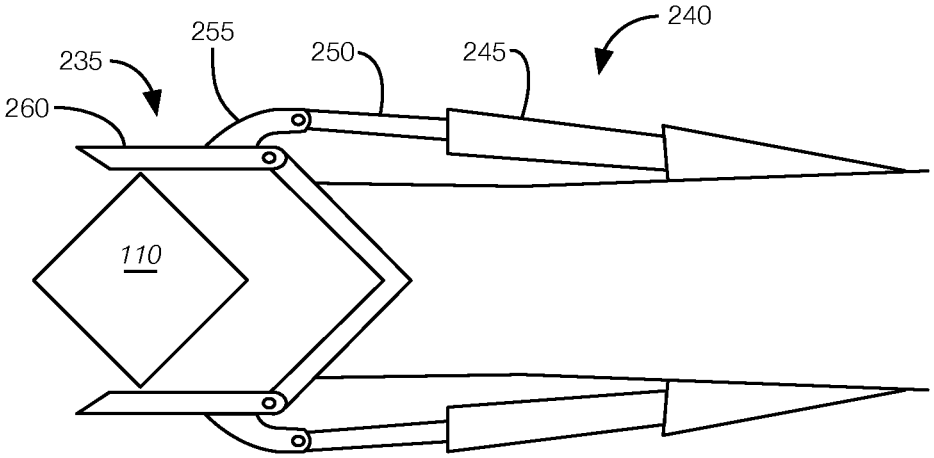
FIGS. 5A-5D illustrate a grip assembly of the parking robot for gripping the lifting rails.
Figure 5B:
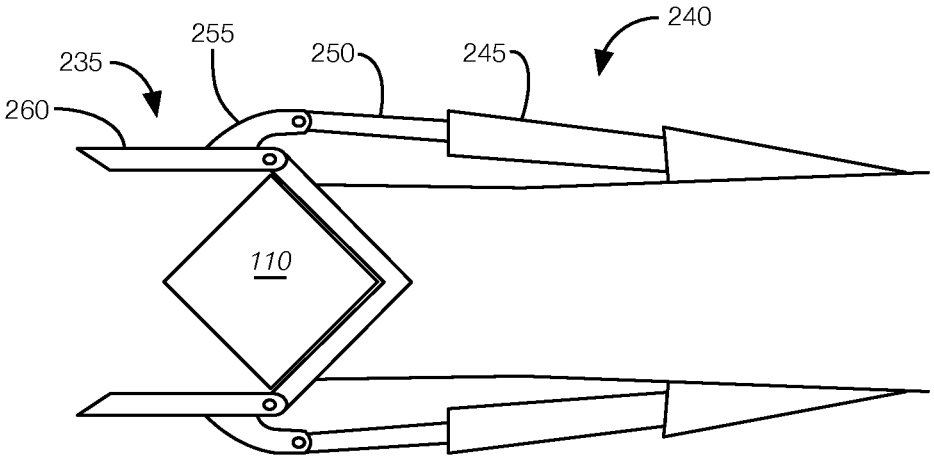
Figure 5C:
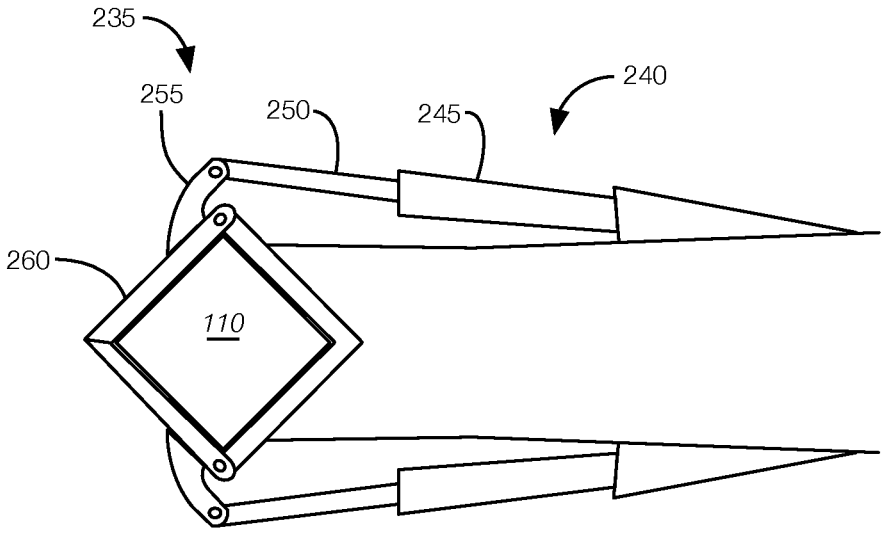
Figure 5D:
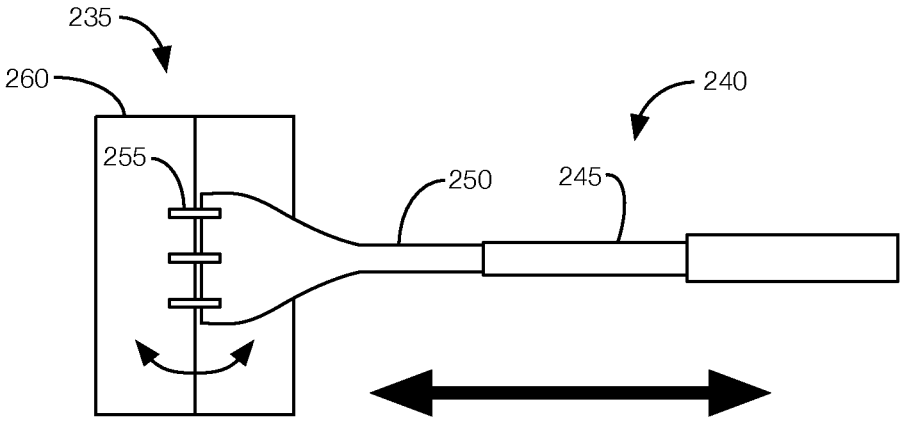

FIGS. 5A-5D illustrate an example grip assembly 115 that may be incorporated into the parking robot 100 for gripping and releasing the lifting rail. As discussed in greater detail below with respect to FIG. 7, the parking robot 100 may grip a pair of lifting rails 110 to use for a particular vehicle 170, park the vehicle 170, and release the lifting rails 110. Thus, a single parking robot 100 may park multiple vehicles 170. The grip assembly 115, as shown in FIGS. 5A-5D, includes an articulated hand 230 and a pneumatic actuator 240. The pneumatic actuator 240 is operatively connected to the articulated hand 230 and moves the hand between an open position and a closed position by converting compressed air into mechanical motion. When in the open position (see FIGS. 5A and 5B), the articulated hand 230 is ready to grip the lifting rail. The parking robot 100 moves the articulated hand 230 toward the lifting rail 110 while the articulated hand 230 is in the open position. When the articulated hand 230 is close enough to the lifting rail, the parking robot 100 modes the articulated hand 230 to the closed position (see FIG. 5C) so that the articulated hand 230 may grip the lifting rail. The parking robot 100 may move the articulated hand 230 to the closed position by triggering the pneumatic actuator 240. For instance, the parking robot 100 may release compressed air into one or more cylinders 245, causing one or more pistons 250 to push parts of the hand toward the lifting rail. In one possible approach, the pistons 250 may push arms 255 that act on one of the fingers 260 of the articulated hand 230, causing the fingers 260 to wrap around the lifting rail. The parking robot 100 may move the articulated hand 230 to the open position by releasing the air from the cylinder 245 and moving away from the lifting rail. Without air in the cylinder 245, the fingers 260 may loosely engage the lifting rail 110, and moving the parking robot 100 away from the lifting rails 110 may provide sufficient force for the fingers 260 to disengage from the lifting rail. FIG. 5D is a side view of one implementation of the grip assembly 115. As shown, multiple arms 255 can act on each of the fingers 260.

Figure 6B:
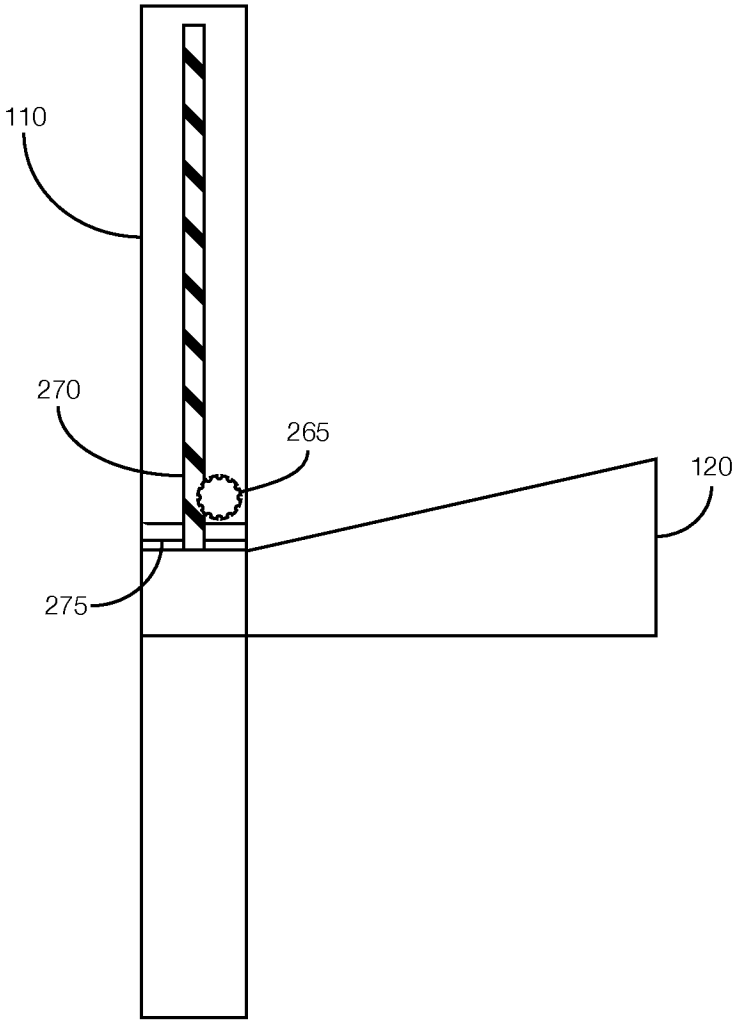
FIGS. 6A-6B illustrate an endless screw and gear powered by a motor for lifting the wheel clamp relative to the lifting rail.
Figure 6A:
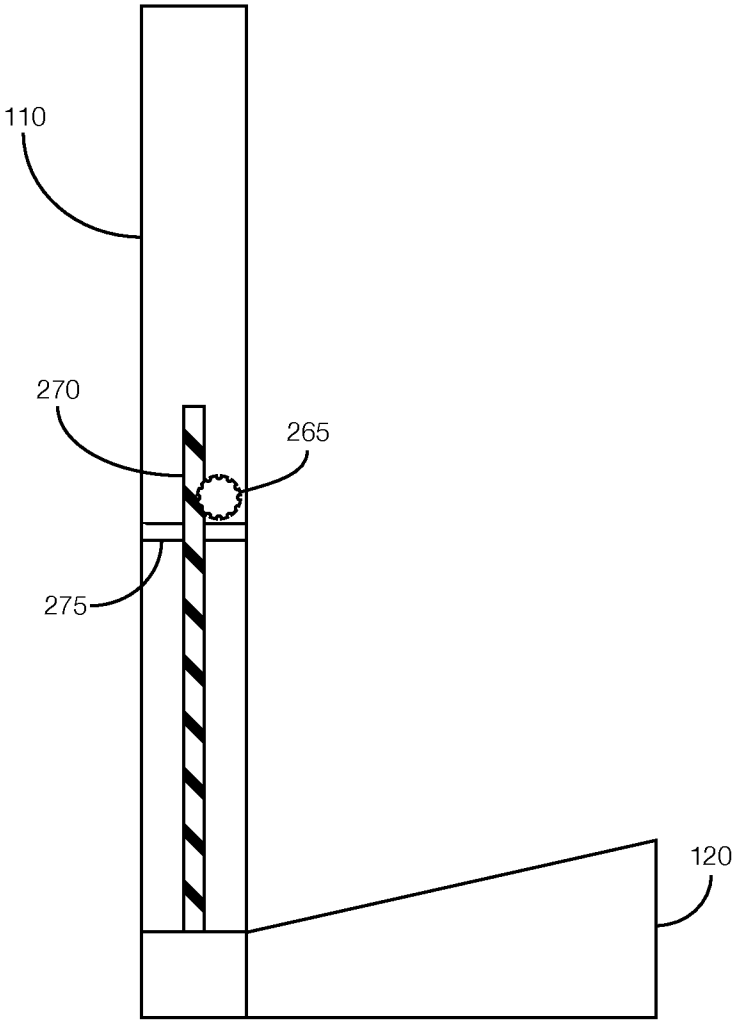

FIGS. 6A and 6B illustrate one way for the parking robot 100 to move the wheel clamps 120 from the first position to the second position. As shown, the lifting rail 110 includes a gear 265 and an endless screw 270. The gear 265 and the endless screw 270 may be located inside the lifting rail. The gear 265 may be operatively connected to the lift motor 125 regardless of whether the lift motor 125 is incorporated into the parking robot 100, incorporated into the floor, incorporated into the lift rails (as shown), or otherwise separate from the parking robot 100 but located somewhere it can still engage the gear 265. That is, the rotation of the shaft of the lift motor 125 may rotate the gear 265. The endless screw 270 may be threaded to receive corresponding threads on the gear 265. Thus, the gear 265 is operatively connected to the endless screw 270. Rotation of the gear 265 may cause the endless screw 270 to move linearly, up and down, along the lifting rail. That is, rotation of the gear 265 in one direction may cause the endless screw 270 to move up and rotation of the gear 265 in the opposite direction may cause the endless screw 270 to move down.

The endless screw 270 may be attached to the wheel clamp 120. For example, the lifting rail 110 may define a track or other opening so that part of the wheel clamp 120 can extend inside the lifting rail. The endless screw 270 may attach to the part of the wheel clamp 120 located inside the lifting rail. Further, the endless screw 270 may attach to a fixed shelf or nut 275 located inside the lifting rail. The fixed shelf 275 may define a threaded hole for receiving the endless screw 270. In some possible implementations, the fixed shelf 275 may be replaced with a threaded nut extending through the lifting rail 110 and the threads of which engaging the threads of the endless screw 270. In some possible approaches, the fixed shelf 275 or threaded nut may be located at the maximum height of the wheel clamp 120. That is, the fixed shelf 275 or threaded nut may define the location of the second position. Thus, the gear 265 may be located above the fixed shelf 275 or threaded nut so the gear 265 does not interfere with the height of the wheel clamp 120 while in the second position.

Accordingly, linear movement of the endless screw 270 up and down the lifting rail 110 may result in corresponding movement of the wheel clamp 120. As such, rotation of the gear 265 by the lift motor 125 can cause the wheel clamp 120 to move from the first position (FIG. 6A) to the second position (FIG. 6B).

Figure 7:
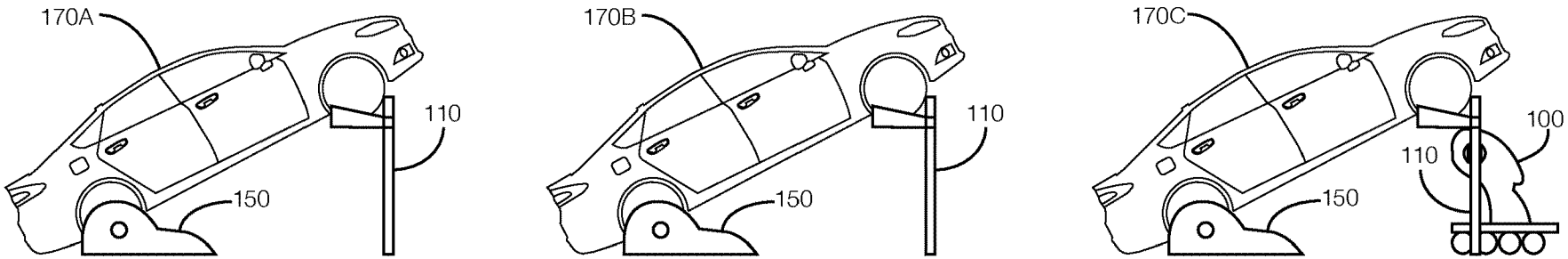
FIG. 7 illustrates multiple vehicles parked by the parking robot.

FIG. 7 illustrates three vehicles 170 parked at an angle by the parking robot 100. The first vehicle 170A and the second vehicle 170B have been parked by the parking robot 100. Further, FIG. 7 illustrates an example where a single parking robot 100 can park multiple vehicles 170. Therefore, the parking robot 100 released the lifting rails 110 for the first vehicles 170A and the second vehicle 170B so that the parking robot 100 could leave to park a third vehicle 170C.

Figure 8A:
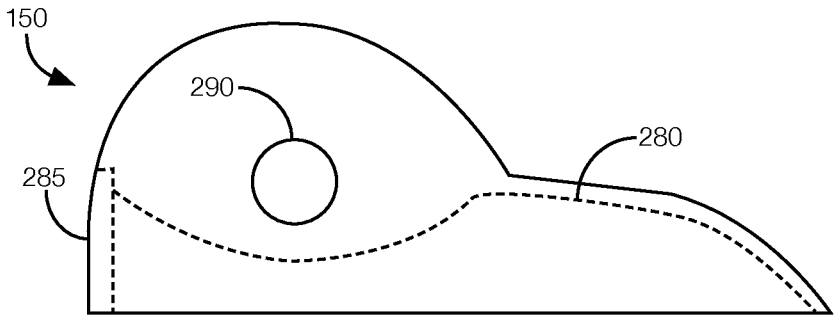
FIGS. 8A-8C illustrate different views of a rear wheel chock.
Figure 8B:
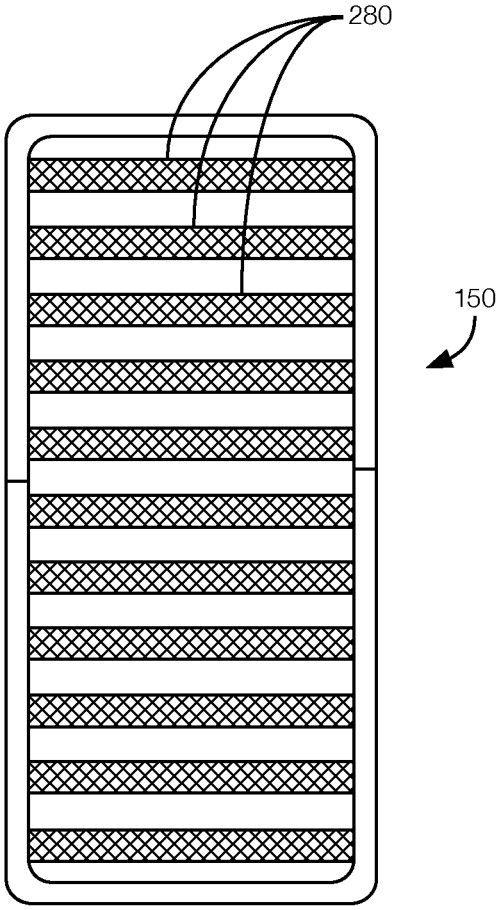
Figure 8C:
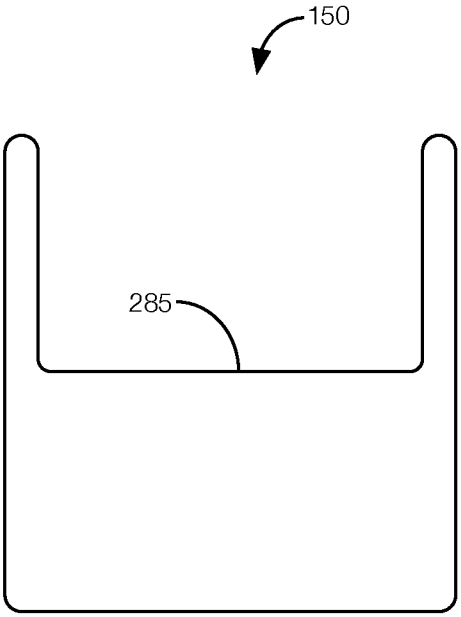

FIGS. 8A-8C illustrate example wheel chocks 150 that may be used to secure the front or rear wheels (e.g., whichever stay closest to the ground) while the vehicle is in an angulated parking position. FIG. 8A is a side view illustrating a curved wheel track 280 and a wall 285. The wheel track 280 may guide the vehicle wheels 230 toward the wall 285, and the curve of the wheel track 280 may reduce the likelihood that the wheel will unintendedly roll out of the wheel chock 150. The wall 285 may help prevent the wheel from unintendedly rolling off the rear of the wheel chock 150. In some instances, the wheel chock 150 may define an opening 290 for receiving a lock bar. That is, the lock bar may be inserted into the opening 290 and extend at least partially through a rim or hubcap of the vehicle wheel 230 to further prevent unintended movement of the wheel. The lock bar may be inserted either after the vehicle is parked or may be at a location that allows the vehicle to be parked angularly (i.e., allows the wheel in the chock to rotate about the vehicle axle) as the wheel clamp 120 moves from the first position to the second position. FIG. 8B illustrates a top view of the wheel chock 150. The track 280 may be formed from bars or rails, and in some instances, may be coated with a high friction material such as a high friction tape. FIG. 8C illustrates a rear view of the wheel chock 150.

Figure 9:
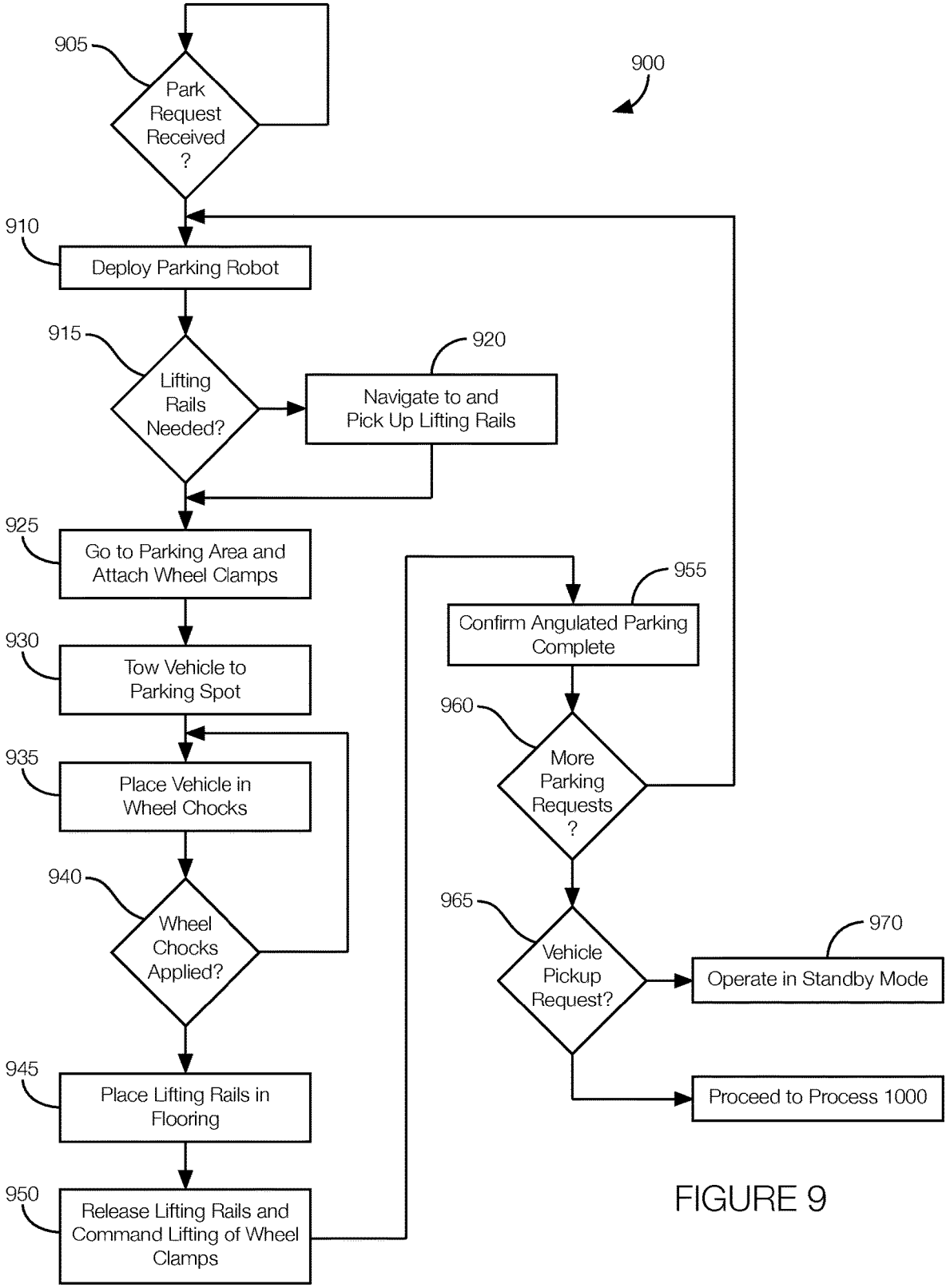
FIG. 9 is a flowchart of an example process that may be implemented by the parking robot to park a vehicle.

FIG. 9 is a flowchart of an example process 900 that may be executed by the parking robot 100. The process 900 may begin after the parking robot 100 is turned on and may continue to execute so long as the parking robot 100 is able to park vehicles.

At decision block 905, the parking robot 100 waits for a request to park a vehicle. The request may be received via the user interface 130. For instance, the request may be received via a user input provided directly to the user interface 130 or via wireless communication with, e.g., a user's mobile device. The processor 145 may process the received user inputs to determine whether the user inputs include a request for the parking robot 100 to park the vehicle. Information included in the request may include the location of the vehicle (e.g., the parking area defined by GPS coordinates), a description of the vehicle, or the like. If the request is received, the process 900 may proceed to block 910. If no request is received, the process 900 may continue to execute block 905 until a request is received.

At block 910, the parking robot 100 is deployed to the parking area to pick up the vehicle. The parking robot 100 may navigate to the parking area according to the location defined by the parking request received at block 905. For instance, the navigation system, autonomous driving sensors 140, wheels 165, drive motor, and processor 145 may work in conjunction with one another to navigate the parking robot 100 to the designated parking area to retrieve the vehicle.

At decision block 915, the parking robot 100 determines whether it needs to take lifting rails 110 to the vehicle. For instance, the processor 145 may determine whether the grip assembly 115 is presently carrying lifting rails 110. The decision may be made via sensors monitoring the position of the articulated hand 230, the position of the piston 250, the amount of air in the cylinder 245, etc. Alternatively, the decision may be inferred from the last command the processor 145 output to the grip assembly 115. For instance, if the last command was to release compressed air into the cylinder 245, the processor 145 may determine that the grip assembly 115 is in the closed position and therefore already is carrying lifting rails 110. If the last command was to release air from the cylinder 245, the processor 145 may determine that the grip assembly 115 is in the open position and therefore not carrying lifting rails 110. If the parking robot 100 needs to pick up lifting rails 110, the process 900 may proceed to block 920. Otherwise, the process 900 may proceed to block 925.

At block 920, the parking robot 100 retrieves lifting rails 110. For instance, the processor 145 may, using signals received from the autonomous driving sensors 140, output command signals to various components of the parking robot 100, such as the navigation system, the drive motor, etc., that cause the parking robot 100 to navigate to someplace where available lifting rails 110 are stored. The processor 145 may output signals to the grip assembly 115 to grab available lifting rails 110. The process 900 may proceed to block 925 after the parking robot 100 picks up the lifting rails 110.

At block 925, the parking robot 100 finds the vehicle associated with the parking request received at block 905 and attaches the wheel clamps 120 to the front or rear wheels 230 of the vehicle 170. Attaching the wheel clamps 120 may include the processor 145 outputting commands to the lift motor 125 to move the wheel clamps 120 to the first position and outputting commands to the wall motor 215 to move the clamping wall 185 to the open position. With the wheel clamp 120 in the first position and the clamping wall 185 in the open position, and the vehicle can be manually or autonomously driven onto the wheel clamps 120. To finish attaching the wheel clamps 120, the processor 145 may output commands to the wheel motor to move the clamping wall 185 to the closed position.

At block 930, the parking robot 100 tows the vehicle to its designated parking spot (e.g., the location where the vehicle will be parked in an angular position). Towing the vehicle may include the processor 145 outputting command signals to move the wheel clamps 120 from the first position to the second position and outputting command signals to drive the wheels 165 of the parking robot 100. Instead of the second position, the processor 145 may instead output a command signal for the lift motor 125 to move the wheel clamps 120 to a towing position (e.g., between the first position and the second position). Another possible approach is to keep the wheel clamps 120 in the first position and for the parking robot 100 to lift the vehicle with its pneumatic suspension. Thus, towing the vehicle may include the processor 145 outputting control signals that cause the pneumatic suspension to at least partially lift the vehicle.

At block 935, the parking robot 100 places the vehicle into the wheel chocks 150 located at the designated parking spot. For instance, if the front wheels 230 of the vehicle 170 are in the wheel clamps 120, the parking robot 100 may position the vehicle so that the rear wheels are in the wheel chocks 150. Alternatively, if the rear wheels 230 of the vehicle 170 are in the wheel clamps 120, the parking robot 100 may position the vehicle so that the front wheels are in the wheel chocks 150. The processor 145 may output commands to the drive motor driving the wheels of the parking robot 100 to position the vehicle accordingly.

At decision block 940, the parking robot 100 determines whether the wheel chocks 150 have been applied to the wheels 230 of the vehicle 170. The processor 145 may make such a determination from sensors located in the wheel chocks 150, sensors located on the parking robot 100, a user input confirming that the wheel chocks 150 have been applied, etc. If the processor 145 determines that the wheel chocks 150 have been applied, the process 900 may proceed to block 945. Otherwise, the process 900 may return to block 935.

At block 945, the parking robot 100 places the lifting rails 110 on the ground. For instance, the parking robot 100, through the autonomous driving sensors 140, may locate particular slots in the floor for receiving the lifting rails 110, and the processor 145 may output control signals to navigate the parking robot 100 to the slots. In some instances, the slots may be located near lift motors 125 that can drive the gear 265 and endless screw 270 located in the lifting rail.

At block 950, the parking robot 100 releases the lifting rails 110 and navigates away from the lifting rails 110. Releasing the lifting rails 110 may include the processor 145 outputting signals for the grip assembly 115 to release the lifting rails 110. After the grip assembly 115 has released the rail, the parking robot 100 may move away from the lifting rail. That is, the processor 145 may output signals to the drive motor that controls the wheels 165 of the parking robot 100. Further, in some possible implementations, the parking robot 100 may wirelessly communicate with the lift motor 125. For example, the processor 145 may command the user interface 130 to wirelessly transmit signals to the lift motor 125 indicating that the lifting rails 110 have been released and instructing the lift motor 125 to begin moving the wheel clamps 120 from the first position (or the towing position) to the second position.

At block 955, the parking robot 100 waits for confirmation that the vehicle has been lifted to the angled parking position. The confirmation to the parking robot 100 may be based on signals received from sensors monitoring the lift motor 125, the position of the vehicle 170, the position of the wheel clamps 120, etc. Alternatively or in addition, the confirmation may be based on signals from sensors located on the parking robot 100 or on a user input provided to the parking robot 100 confirming that the vehicle is in the angulated parking position. The processor 145 may determine whether confirmation has been received after processing such signals.

At decision block 960, the parking robot 100 determines whether more vehicles are queued for angulated parking. For instance, the processor 145 may make this determination based on whether more parking requests (see block 905) have been received. If so, the process 900 may proceed to block 910. If not, the process 900 may proceed to block 965.

At decision block 965, the parking robot 100 determines if there is a vehicle delivery request pending for that parking robot 100. Vehicle delivery requests are discussed below with respect to block 1005. In short, if the processor 145 determines that one or move vehicle delivery requests have been received, the process 900 ends and the process 1000 begins for that parking robot 100. If there are no pending vehicle delivery requests for the parking robot 100, the process 900 may proceed to block 970.

At block 970, the parking robot 100 enters a standby mode. The standby mode may be a low power mode where certain components are turned off, at least until the parking robot 100 is ready to park a vehicle or retrieve a parked vehicle. The standby mode may be controlled in accordance with signals output by the processor 145 to, e.g., turn off certain components. The process 900 may proceed to block 960.

Figure 10:
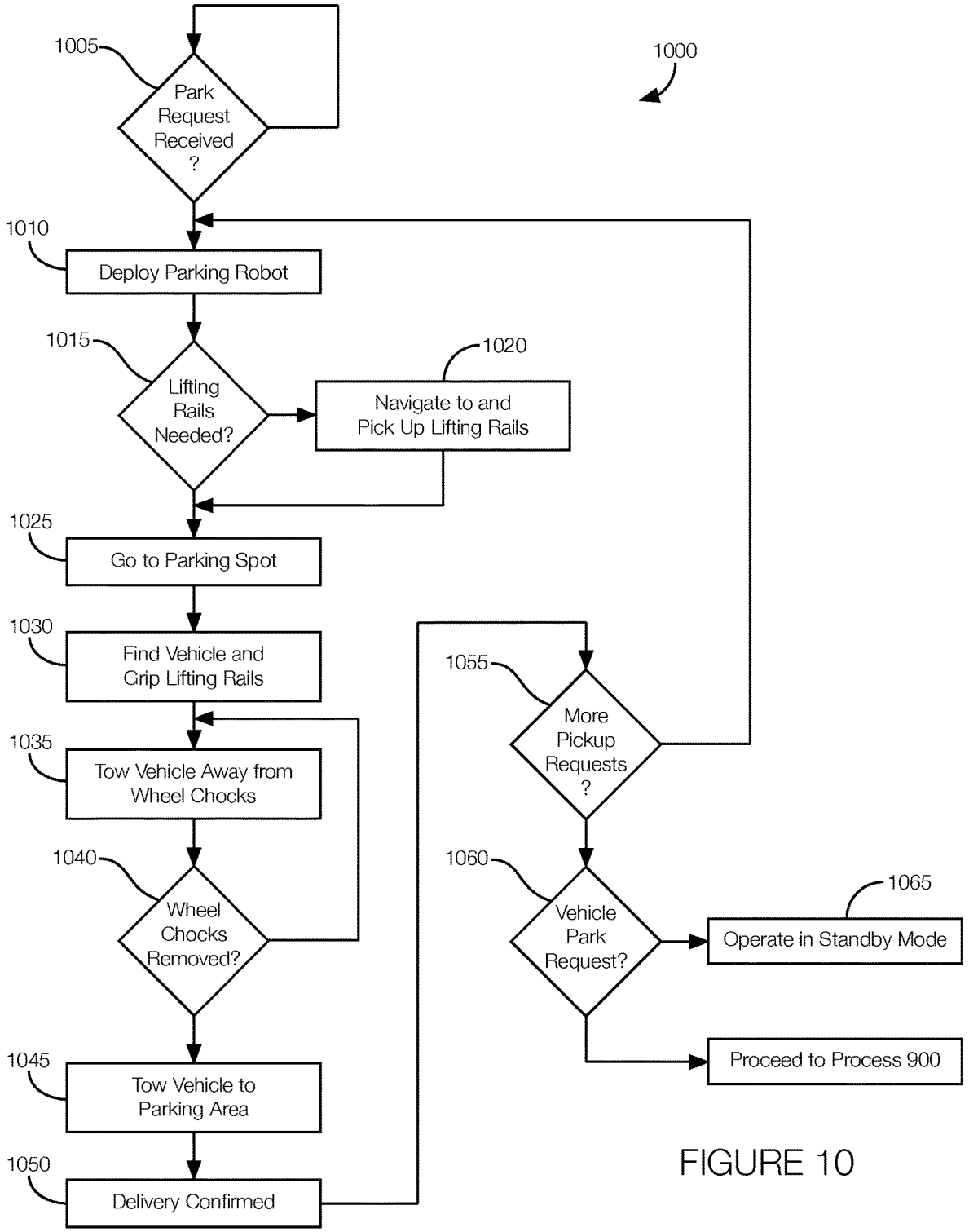
FIG. 10 is a flowchart of an example process that may be implemented by the parking robot to retrieve a parked vehicle.

FIG. 10 is a process flow diagram of an example process 1000 that may be executed by the parking robot 100 to retrieve a parked vehicle. The process 1000 may begin after the parking robot 100 is turned on and may continue to execute so long as the parking robot 100 is able to retrieve parked vehicles.

At decision block 1005, the parking robot 100 waits for a request to retrieve a parked vehicle. The request may be received via the user interface 130. For instance, the request may be received via a user input provided directly to the user interface 130 or via wireless communication with, e.g., a user's mobile device. The processor 145 may process the received user inputs to determine whether the user inputs include a request for the parking robot 100 to retrieve the parked vehicle. Information included in the request may include the location of the parked vehicle (e.g., the parking spot defined by GPS coordinates), a description of the vehicle 170, or the like. If the request is received, the process 1000 may proceed to block 1010. If no request is received, the process 1000 may continue to execute block 1005 until a request is received.

At block 1010, the parking robot 100 is deployed to the parking spot where the vehicle is parked. The parking robot 100 may navigate to the parking area according to the location defined by the pickup request received at block 1005. For instance, the navigation system, autonomous driving sensors 140, wheels 165, drive motor, and processor 145 may work in conjunction with one another to navigate the parking robot 100 to the designated parking spot to retrieve the parked vehicle.

At decision block 1015, the parking robot 100 determines whether it is presently carrying lifting rails 110. For instance, the processor 145 may determine whether the grip assembly 115 is presently carrying lifting rails 110. The decision may be made via sensors monitoring the position of the articulated hand 230, the position of the piston 250, the amount of air in the cylinder 245, etc. Alternatively, the decision may be inferred from the last command the processor 145 output to the grip assembly 115. For instance, if the last command was to release compressed air into the cylinder 245, the processor 145 may determine that the grip assembly 115 is in the closed position and is therefore carrying lifting rails 110. If the last command was to release air from the cylinder 245, the processor 145 may determine that the grip assembly 115 is in the open position and is therefore not carrying lifting rails 110. If the parking robot 100 is carrying lifting rails 110, the process 1000 may proceed to block 1020. Otherwise, the process 1000 may proceed to block 1025.

At block 1020, the parking robot 100 takes the lifting rails 110 to a designated storage area. For instance, the processor 145 may output signals that navigate the parking robot 100 to the designated storage area for the lifting rails 110. When the parking robot 100 has arrived at the designated storage area, the processor 145 may output signals for the grip assembly 115 to release the lifting rails 110. When the parking robot 100 is no longer carrying the lifting rails 110, the process 1010 may proceed to block 1015 to confirm that the parking robot 100 is no longer carrying lifting rails 110.

At block 1025, the parking robot 100 navigates to the parking spot where the parked vehicle is located. For instance, the processor 145 may output signals that navigate the parking robot 100 to the parking spot identified in the pickup request.

At block 1030, the parking robot 100 finds the parking spot and grips the lifting rails 110. Gripping the lifting rails 110 may include the processor 145 outputting signals to the grip assembly 115 to move to the closed position around the lifting rails 110. In some possible approaches, the processor 145 may wirelessly communicate with the lift motor 125 via the user interface 130 by, e.g., commanding the lift motor 125 to lower the wheel clamps 120 to a position between the first and second positions (e.g., the towing position).

At block 1035, the parking robot 100 tows the vehicle away from the wheel chocks 150. Towing the vehicle may include the processor 145 outputting command signals to drive the wheels 165 of the parking robot 100. In some instances, towing the vehicle may include the processor 145 outputting control signals for the lift motor 125 to move the wheel clamps 120 to a towing position (e.g., between the first position and the second position). Another possible approach is for the lift motor 125 to lower the wheel clamps 120 to the first position and for the parking robot 100 to lift the vehicle with its pneumatic suspension. Thus, towing the vehicle may include the processor 145 outputting control signals that cause the pneumatic suspension to at least partially lift the vehicle.

At decision block 1040, the parking robot 100 determines whether the wheels have been released from the wheel chocks 150. The processor 145 may make such a determination from sensors located in the wheel chocks 150, sensors located on the parking robot 100, a user input confirming that the vehicle has been removed from the wheel chocks 150, etc. If the processor 145 determines that the vehicle is clear of the wheel chocks 150, the process 1000 may proceed to block 1045. Otherwise, the process 1000 may return to block 1035.

At block 1045, the parking robot 100 tows the vehicle to a pickup area where, e.g., the owner of the vehicle 170 can enter the vehicle and drive away. Towing the vehicle to the pickup area may include the processor 145 outputting control signals that cause the parking robot 100 to navigate to the pickup area in accordance with signals received from the navigation system, the autonomous driving sensors 140, etc. When the parking robot 100 arrives at the pickup area, the processor 145 may output control signals to lower the wheel clamps 120 from the second position or towing position to the first position, to lower the vehicle by lowering the pneumatic suspension of the parking robot 100, moving the clamping wall 185 to the open position, remove the wheel clamps 120 from the wheels 230 of the vehicle 170, etc.

At block 1050, the parking robot 100 confirms delivery of the vehicle 170 at the pickup area. The processor 145 may confirm delivery according to signals output by sensors 140 located on the parking robot 100, other sensors communicating with the parking robot 100, a user input provided to the user interface 130, etc.

At decision block 1055, the parking robot 100 determines if there is a subsequent delivery request pending for that parking robot 100. If the processor 145 determines that one or move vehicle delivery requests have been received, the process 1000 proceeds to block 1010. If there are no pending vehicle delivery requests for the parking robot 100, the process 1000 may proceed to block 1060.

At decision block 1060, the parking robot 100 determines whether any vehicles are queued for angulated parking. For instance, the processor 145 may make this determination based on whether any parking requests (see block 905) have been received. If so, the process 1000 may end and the process 900 may begin. If no vehicles are queued for angled parking, the process 1000 may proceed to block 1065.

At block 1065, the parking robot 100 enters a standby mode. The standby mode may be a low power mode where certain components are turned off, at least until the parking robot 100 is ready to park a vehicle or retrieve a parked vehicle. The standby mode may be controlled in accordance with signals output by the processor 145 to, e.g., turn off certain components. The process 1000 may proceed to block 1055.

In general, the computing systems and/or devices described may employ any of a number of computer operating systems, including, but by no means limited to, versions and/or varieties of the Ford Sync® application, AppLink/Smart Device Link middleware, the Microsoft Automotive® operating system, the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OSX and iOS operating systems distributed by Apple Inc. of Cupertino, Calif., the BlackBerry OS distributed by Blackberry, Ltd. of Waterloo, Canada, and the Android operating system developed by Google, Inc. and the Open Handset Alliance, or the QNX® CAR Platform for Infotainment offered by QNX Software Systems. Examples of computing devices include, without limitation, an on-board vehicle computer, a computer workstation, a server, a desktop, notebook, laptop, or handheld computer, or some other computing system and/or device.

Computing devices generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. Some of these applications may be compiled and executed on a virtual machine, such as the Java Virtual Machine, the Dalvik virtual machine, or the like. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A parking robot comprising:
a lifting rail;
a wheel clamp disposed on the lifting rail and moveable from a first position to a second position along the lifting rail; and
a lift motor operatively connected to the lifting rail, wherein the lift motor moves the wheel clamp from the first position to the second position,
wherein the wheel clamp includes:
a first side wall;
a second side wall spaced from the first side wall; and
a clamping wall hingedly attached to the first side wall and movable from an open position to a closed position, wherein the clamping wall is disposed on the first side wall and the second side wall when in the closed position and is biased toward the open position; and
a wall actuator operatively connected to the clamping wall for moving the clamping wall from the open position to the closed position.

2. The parking robot of claim 1, wherein the lifting rail includes a gear operatively connected to an endless screw, and wherein the lift motor is operatively connected to the gear and the endless screw is attached to the wheel clamp.

3. The parking robot of claim 2, wherein rotation of the lift motor rotates the gear, and wherein rotation of the gear linearly moves the endless screw.

4. The parking robot of claim 1, further comprising:
a housing; and
a grip assembly extending from the housing to the lifting rail, wherein the grip assembly includes an articulated hand for gripping and releasing the lifting rail.

5. The parking robot of claim 4, wherein the grip assembly includes a pneumatic actuator operatively connected to the articulated hand for moving the articulated hand between an open position and a closed position.

6. The parking robot of claim 1, wherein the wall actuator includes:
a wall motor;
an endless screw operatively connected to the wall motor; and
a finger disposed on the endless screw and engageable with the clamping wall, wherein rotation of the endless screw by the wall motor rotates the finger to move the clamping wall from the open position to the closed position.

7. A parking robot comprising:
a housing;
a lifting rail;

a wheel clamp disposed on the lifting rail and moveable from a first position to a second position along the lifting rail;

a grip assembly extending from the housing to the lifting rail, wherein the grip assembly includes an articulated hand for gripping and releasing the lifting rail; and a lift motor operatively connected to the lifting rail, wherein the lift motor moves the wheel clamp from the first position to the second position.

8. The parking robot of claim 7, wherein the lifting rail includes a gear operatively connected to an endless screw, and wherein the lift motor is operatively connected to the gear and the endless screw is attached to the wheel clamp.

9. The parking robot of claim 8, wherein rotation of the lift motor rotates the gear, and wherein rotation of the gear linearly moves the endless screw.

10. The parking robot of claim 7, wherein the grip assembly includes a pneumatic actuator operatively connected to the articulated hand for moving the articulated hand between an open position and a closed position.

11. The parking robot of claim 7, wherein the wheel clamp includes:

a first side wall;

a second side wall spaced from the first side wall; and a clamping wall hingedly attached to the first side wall and movable from an open position to a closed position, wherein the clamping wall is disposed on the first side wall and the second side wall when in the closed position.

12. The parking robot of claim 11, wherein the clamping wall is biased toward the open position.

13. The parking robot of claim 12, wherein the wheel clamp includes a wall actuator operatively connected to the clamping wall for moving the clamping wall from the open position to the closed position.

14. The parking robot of claim 13, wherein the wall actuator includes:

a wall motor;

an endless screw operatively connected to the wall motor; and a finger disposed on the endless screw and engageable with the clamping wall, wherein rotation of the endless screw by the wall motor rotates the finger to move the clamping wall from the open position to the closed position.

* * * * *